US006814092B2

(12) United States Patent
Lachawiec, Jr. et al.

(10) Patent No.: US 6,814,092 B2
(45) Date of Patent: Nov. 9, 2004

(54) SYSTEMS AND METHODS FOR CONDITIONING ULTRA HIGH PURITY GAS BULK CONTAINERS

(75) Inventors: Anthony J. Lachawiec, Jr., Bethlehem, PA (US); Vladimir Yliy Gershtein, Allentown, PA (US); Ronald Martin Pearlstein, Macungie, PA (US); Robert William Ford, Schnecksville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/607,897

(22) Filed: Jun. 27, 2003

(65) Prior Publication Data

US 2004/0045802 A1 Mar. 11, 2004

Related U.S. Application Data

(62) Division of application No. 09/966,195, filed on Sep. 28, 2001, now Pat. No. 6,616,769.

(51) Int. Cl.[7] ..... B08B 9/08

(52) U.S. Cl. ..... 134/166 R; 134/105; 134/150

(58) Field of Search ..... 134/166 R, 105, 134/106, 31, 10, 11, 22.1; 62/48.1, 50.2; 202/160, 182

(56) References Cited

U.S. PATENT DOCUMENTS 1,891,592 A * 12/1932 Fitzgerald ..... 134/24
2,956,911 A 10/1960 Jelen ..... 134/22
3,699,982 A * 10/1972 Pipkins ..... 134/22.19
4,357,212 A 11/1982 Osterman et al. ..... 202/170
4,597,768 A 7/1986 Thijssen et al. ..... 23/299
4,944,837 A * 7/1990 Nishikawa et al. ..... 216/41
5,456,759 A * 10/1995 Stanford et al. ..... 134/1
6,056,929 A 5/2000 Hassal ..... 423/249
6,616,769 B2 * 9/2003 Lachawiec et al. ..... 134/10

FOREIGN PATENT DOCUMENTS

JP 95096257 4/1995 ..... B08B/3/08

OTHER PUBLICATIONS

"Erlenmeyer Flask–Reflux Cap for Acid Sample Decomposition," Siemer and Brinkley, Analytical Chemistry, 1981, vol. 53, No. 4, pp. 750–751.

"Testing of Immersion Heaters for In–Tank Solidfication Circulators," J. Dunn, Battelle–Northwest Lab Report No. BNWL–101, 1965.

* cited by examiner

*Primary Examiner*—Michael Barr
*Assistant Examiner*—Saeed Chaudhry
(74) *Attorney, Agent, or Firm*—Geoffrey L. Chase

(57) ABSTRACT

A process and system for conditioning a bulk container for ultra-high purity liquefied gas. Vapor is generated in the container from a conditioning quantity of the ultra-high purity liquefied gas by imposing a temperature difference on the container so that the vapor condenses when a temperature difference is achieved. The resulting liquid reflux, e.g., the condensed liquid drips or flows back to the conditioning quantity of the liquified gas, washes or removes contaminants, e.g., particles, metal and moisture, from the interior surface of the container. A portion of the vapor is vented from the container for reclamation. The used conditioning liquid may also be reclaimed.

5 Claims, 2 Drawing Sheets

SYSTEMS AND METHODS FOR CONDITIONING ULTRA HIGH PURITY GAS BULK CONTAINERS

CROSS-REFERENCE TO RELATED APPLICATIONS

The present application is a divisional application of U.S. Ser. No. 09/966,195 filed Sep. 28, 2001 now U.S. Pat. No. 6,616,769.

BACKGROUND OF THE INVENTION

This invention is directed generally to conditioning, e.g., cleaning, the interior surface of hollow containers, and more particularly to conditioning the hollow interior of a bulk container used for the storage of a charge of an ultra-high purity liquified gas by means of a vaporization-condensation reflux action of the liquified gas.

At present a need exists for conditioning transportable or stationary bulk containers, e.g., containers having a capacity in excess of 49 liters, so that they are suitable for storing liquified gas products that meet the moisture, metal contaminant, and particle specifications for ultra high purity (UHP) for high-technology industries. As will be appreciated by those skilled in the art the meaning of the term UHP varies from application to application. For example, in some applications a UHP product is defined as having contaminants at <1 ppm. In other so-called UHP applications the level of contaminants can be higher or lower. While various systems and techniques have been disclosed in the prior art for cleaning small vessels or other small containers, or small parts, such systems and techniques are not suitable for conditioning bulk containers.

For example, some prior art systems, like those to be described later, make use of an exogenous solvent to condition or clean the walls of a container or other part. The use of such solvents is less than desirable for various reasons, one of the most significant being that some solvent may remain as a potential contaminant.

Other systems for cleaning or conditioning containers roll or otherwise agitate the container during the conditioning process. As will be appreciated this approach is impractical and is potentially dangerous for bulk container applications.

The use of condensate reflux for conditioning or cleaning containers or tanks offers various advantages over the above mentioned prior art cleaning techniques. As will be appreciated by those skilled in the art, condensate reflux, in general, is a well known one for various applications. For example, it is known to use vaporization and condensate reflux to purify a liquid sample. Such a method is known universally as distillation and is a common laboratory and industrial procedure for purification of liquids. A laboratory scale apparatus illustrative of this type of prior art is described in Siemer and Brinkley (*Analytical Chemistry,* 1981, Vol. 53, No. 4, 750–751). This application employs an Erlenmeyer flask with a novel reflux cap to purify a sample of acid. When used in such a way, refluxing acid rinses the walls of the flask continuously and provides the benefits of preventing droplet loss during spattering and providing a safe means of adding other reagents to the flask.

It is also known to use vaporization and reflux as a vehicle to collect product in solution. An apparatus illustrative of this type of prior art is disclosed in U.S. Pat. No. 6,056,929 (Hassal). The apparatus and process disclosed is for the production of radioactive Iodine-125 from the decay of irradiated Xenon-124. The Iodine-125 product coats the vessel used to collect it and a reflux of an aqueous sodium hydroxide solution is used to rinse the product from the walls. Heat is applied at the base of the vessel by immersing the collection vessel in a water bath containing a heater element. This operation vaporizes some of water from the sodium hydroxide solution, which subsequently condenses on all internal walls of the container and dissolves Iodine-125 from the walls before dripping into the pool of sodium hydroxide at the bottom of the vessel. At the end of the reflux procedure, the water bath is replaced with an ice bath to cool the vessel and condense any remaining water vapor into the liquid pool. The liquid product, a sodium hydroxide solution containing Iodine-125, is drained from the collection vessel into a container suitable for storage and delivery.

The use of a condenser and an evaporator coil to produce reflux liquid of a solvent is a well known technique suitable for cleaning metal parts. Such a device is known as a vapor degreaser. U.S. Pat. No. 4,357,212 (Osterman et al.) and Japanese Unexamined Patent Application No. JP95096257A are illustrative of such devices. In such a device, the degreasing solvent is vaporized in a chamber where metal parts are placed. The hot vapor condenses on the metal surfaces, forming a liquid stream that solubilizes grease, oils, and dirt. The liquid drips into the sump and carries with it the contaminants. Any non-condensed vapors are liquefied by a condenser coil at the top of the chamber. In the patent to Osterman et al. the process uses a closed refrigeration cycle with a compressor, vaporizer, condensing coil, and a vapor-liquid separator to generate vapor and reflux of cleaning solvent in the cleaning chamber. The Japanese patent uses a heating coil to generate solvent vapors and a water-cooled condenser to create reflux. While such systems may be suitable for their intended purposes, they necessitate the use of a condenser, which in the case of a bulk storage container would have to be located either internally or externally of the container to produce the liquid reflux condensate.

Another known cleaning application using reflux liquid is washing the surface of immersion heaters installed in waste tanks. An example of such a process is described by Dunn (*Battelle-Northwest Lab Report No. BNWL*-101, 1965). Immersion heaters are installed inside waste tanks to concentrate contaminants in the liquid phase and an external condenser is used to generate reflux. While this technique may also be suitable for its intended purposes it does not allow the vessel to be used for ultra-high purity product without further cleaning since it uses a waste stream that is completely discarded.

U.S. Pat. No. 2,956,911 (Jalen) discloses a vapor phase and reflux liquid treatment of rubberlike elastomer claddings on vessels to aid in the removal of such claddings from the metal surface. In particular, in this patent a suitable solvent is chosen dependent upon the nature of the elastomer to be removed. The vessel is filled with an amount of solvent that covers a heating element at the base. Heat is applied, which generates solvent vapors. The solvent vapors are condensed and returned to the vessel as reflux; no solvent vapor is purged from the vessel. The combined vapor contact and liquid washing effect breaks the bond between the elastomer cladding and the metal surface of the vessel. After treating the coating with solvent for a suitable period, heat is removed and the vessel is cooled. The solvent is drained from the vessel as a liquid and any residual solvent vapors are removed with steam treatments. The coating is easily removed from the metal surface if it has not already sloughed off in sheets.

U.S. Pat. No. 4,597,768 (Thijssen et al.) discloses a method for concentrating a suspension of solid particles by moving it through a contact zone, wherein the particles are separated from a mixture by crystallization using a cooled heat exchanger prior to being moved through the contact zone.

BRIEF SUMMARY OF THE INVENTION

The present invention relates to process for conditioning a bulk container and a bulk container conditioning system. The bulk container is arranged for storing a charge of an ultra high purity liquified gas and has at least one wall with an interior surface bounding a hollow interior.

The method entails providing a conditioning quantity of the ultra high purity liquified gas into the interior of the container so that a gas space is created above the level of the conditioning quantity of the liquified gas. A temperature difference is imposed on the container to cause the conditioning quantity of the liquified gas to produce vapor in the gas space. The vapor is enabled to condense on the interior surface of the container, without the use of a condenser, whereupon liquid reflux is created. The liquid re flux washes the interior surface of the container, e.g., removes any moisture, impurities, metals, etc. from the interior surface of the container, to condition that surface so that the container is ready to accept for storage a fresh charge of the ultra high purity liquified gas.

In accordance with one aspect of the invention when the ultra-high liquified gas liquifies at a temperature at or above the ambient temperature, the method entails and the system makes use of a heating element for heating the container to impose the temperature difference on the container to produce the vapor for condensation on the interior surface of the container. Moreover, a venting valve is provided to enable a portion of the vapor produced to vent from the gas space. For liquified gases that liquify at a temperature below the ambient temperature the method entails and the system makes use of a venting valve for enabling a portion of the vapor to vent from the interior of the container to cause the portion of the vapor remaining within the gas space to condense on the interior surface of the container to produce the liquid reflux.

In either method the liquid reflux that washes the interior of the container reunites with the conditioning quantity of liquified gas within the container to produce a degraded quantity of the liquified gas in the container for ultimate removal and optional reclamation to produce a quantity of ultra high purity liquified gas suitable for reuse.

In accordance with another aspect of the invention the vapor which is vented from the valve may also be reclaimed to produce a quantity of the ultra high purity liquified gas.

DETAILED DESCRIPTION OF THE INVENTION

This present invention relates to processes and systems to condition or clean bulk containers or vessels for holding ultra high purity gases using a condensate reflux of the same liquified gas that is to be stored in the container or vessel. The systems and methods of this invention can be used with any type of bulk storage vessel, be it stationary or transportable and with any type of ultra-high purity liquified gas.

Figure 1:
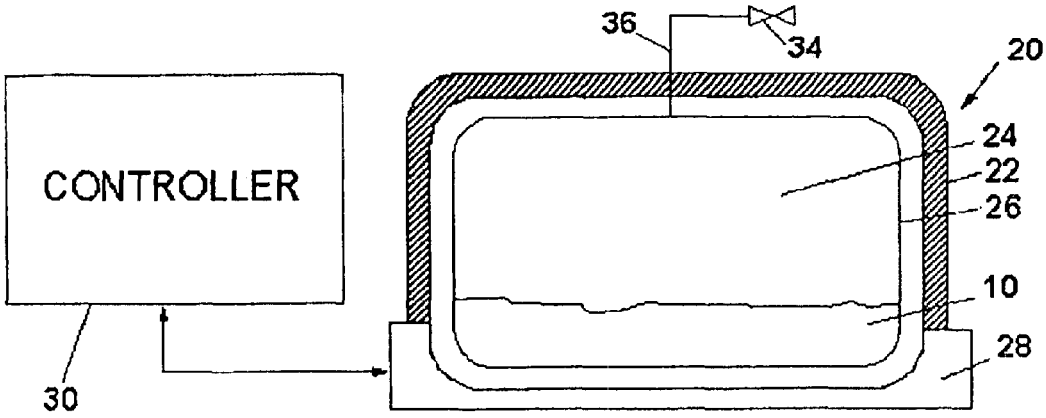
FIG. 1 is a schematic diagram of one embodiment of a system of the subject invention shown at an initial step in the conditioning of a bulk container, e.g., a storage tank for storing a charge of an ultra high purity liquified gas which is liquified at or above the ambient temperature.
Figure 2:
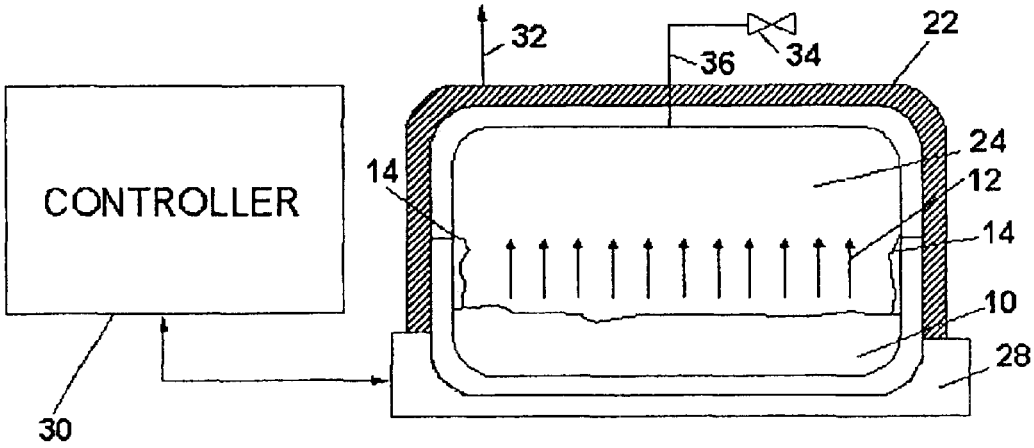
FIG. 2 is a schematic like that of FIG. 1, but showing a later step in the conditioning of the bulk container.
Figure 3:
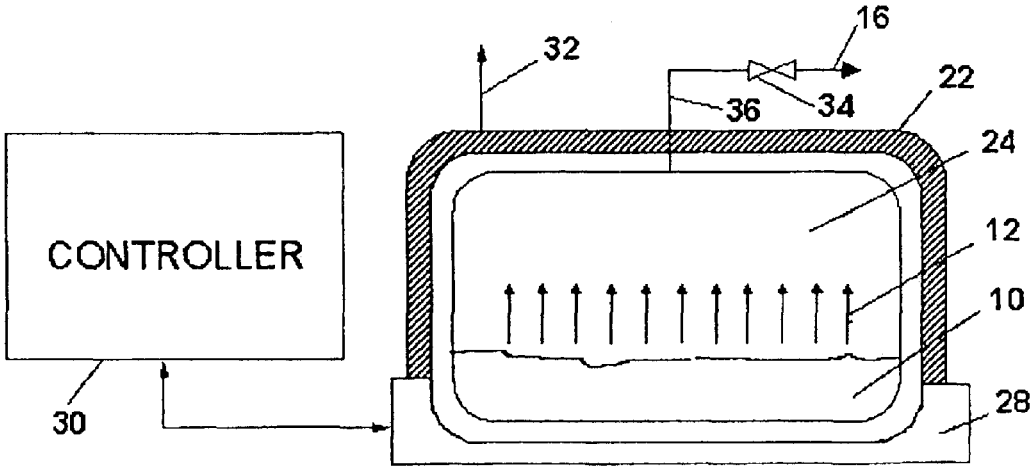
FIG. 3 is a schematic like that of FIGS. 1 and 2, but showing a still later step in the conditioning of the bulk container.

In one exemplary embodiment of the invention, shown in FIGS. 1–3, and to be described first, the liquid reflux is generated by at least one heat and purge cycle to wash the internal walls of the container or vessel with a liquid condensate of a gas that liquifies at or above the ambient temperature. In another exemplary embodiment of the invention, shown in FIGS. 4–7, the reflux is generated by at least one purge and vaporization cycle for a gas that liquefies below ambient temperature.

It must be pointed out at this juncture that the embodiments of the systems and methods shown in the figures are merely exemplary of various systems and methods that can be utilized in accordance with this invention to condition bulk storage tanks for liquified gases. Moreover, the systems and methods of this invention can be used with all types of liquified gases, particularly those used in ultra high purity applications.

Referring now to FIG. 1 there is shown a system 20 for conditioning a bulk storage tank 22 to clean the interior surface of the tank. The tank 22 is arranged to hold and store a charge of any ultra high purity liquified gas which is liquified at or above the ambient temperature. One such exemplary gas is Freon-22. Freon-218, Hydrogen Chloride, Ammonia, Sulfur Dioxide, Sulfur Hexafluoride, Tungsten Hexafluoride, and Propylene are examples of other gases that may be used by the system 20 or in accordance with the first embodiment of the method of this invention. It should be noted that the foregoing gases are merely exemplary of many other gases that can be used and which liquify at or above ambient temperature.

The tank 22 can be of any suitable construction, e.g., a conventional insulated delivery tank having an inner wall and an insulated outer wall. The tank includes a hollow interior 24 bounded by the interior surface 26 of the tank's inner wall and into which the charge of the liquefied gas is introduced to store until it is to be used. Before storing the charge of the ultra high purity liquified gas, the interior surface 26 of the tank must be conditioned or cleaned of any contaminants, e.g., moisture, particle or metal contaminants, which could degrade the purity of the charge. That action is achieved by introducing into the interior of the tank a "conditioning" amount or body 10, i.e., a predetermined volume that is substantially less than the tank's capacity, of the same ultra high purity liquified gas that will constitute the charge to be stored as shown in FIG. 1. The liquified "conditioning" charge body 10 is arranged to be vaporized in the tank 22 and to condense on the tank's interior surface 26, as shown in FIG. 2, to result in a reflux of the condensate and any contaminant(s) that had been on the interior surface 26 back into the conditioning charge's liquid body 10.

The vaporization and condensation of the conditioning charge is effected by the application of a temperature difference to the tank. To that end, in this embodiment heat is applied to the tank and the conditioning charge in it by a heating element 28. The heating element 28 may be of any suitable construction, e.g., an electrical resistance heater or some other electrically operated heater. The heater element 28 is preferably located, e.g., mounted, on the exterior of the tank 22 in the vicinity of the portion of the tank in which the conditioning charge is to be located, e.g., a the bottom of the tank and without any insulation layer being interposed between it and the inner wall of the tank, to facilitate heat transfer to that inner wall and the contiguous conditioning charge. The operation of the heating element 28 is controlled by a controller 30 to turn the heating element on and off and to adjust its temperature, as desired, as will be described later.

The system 20 also includes a purge valve 34, connected to the interior of the tank via a purge line 36. The outlet of the purge valve serves to carry the purged gas to some remote location for reclamation. If no reclamation of the purged gas is desired it may be disposed of in any suitable safe and ecologically responsible manner. The tank 22 also includes an outlet port (not shown) in communication with the bottom of the interior of the tank to enable the conditioning charge and any contaminants washed from the tank's interior walls by the method of this invention to be removed from the tank for reclamation of the gas or for suitable disposal if reclamation isn't desired.

Referring to FIGS. 1–3 the details of the operation of the system 20 and its method of use will now be described. First, the bulk storage and delivery vessel or tank 22 is charged with the conditioning charge 10 of the liquid ultra-high purity product to fill it to a level sufficient to cover the externally located heating element 28 as shown in FIG. 1. At the end of this filling step, the tank 22 is at ambient temperature, e.g., 70° F., and the corresponding vapor pressure of the gas (e.g., Freon-22) making up the conditioning charge 10. The controller 30 then operates to energize the heating element 28 to control the heater's output to a temperature, e.g., 120° F., sufficient to cause a portion of the conditioning liquid charge 10 to vaporize, with the resulting vapor being shown by the arrows bearing the reference numeral 12 in FIG. 2. In particular, the heating element causes a portion of the conditioning charge 10 to vaporize, whereupon the hot vaporized liquid 12 condenses on the interior surface 26 of the tank 22 which is at ambient temperature. This action forms a condensation front 14. The condensate or "reflux liquid" making up the front has the tendency to drip or otherwise flow back along the tank's interior surface 26 to the liquid body 10 of the conditioning charge under the influence of gravity, thereby washing or carrying with it any particle, moisture or metal contamination that had been on that surface. The controller 30 is arranged to operate automatically, e.g., it remains in its automatic mode for a period of time sufficient to provide a thorough washing of the vessel interior walls with the reflux liquid for a given liquified gas product.

Once the heating element 28 has been heating the conditioning charge 10 for the time pre-specified or as determined by the controller 30 for the particular liquified gas product the heater is de-energized by the controller. The operation of the controller 30 takes into account the heat loss or leakage through the walls of the tank 22, which loss is schematically shown in FIG. 2 by the arrow bearing the reference numeral 32, and which tends to extend the reflux period. The controller 30 remains in the automatic mode to energize the heating element for the desired time period, e.g., 7 to 17 days. The tank's wall equilibrates (i.e., closely approaches equilibrium) with the temperature of the heating element, e.g., 120° F. after approximately 17 days have passed. At this time the reflux process ceases and the system 20 is at equilibrium at this temperature and at the corresponding Freon-22 vapor pressure. The heating element 28 is then de-energized by the controller 30.

The purge valve 34 can then be opened, either manually or by some automated means (not shown), as shown in FIG. 3 to enable a portion, e.g., 60%, of the vapor 12 to vent as a purge stream 16. The purge stream 16 exits the tank via line 36 for a period of time specific for the particular gas product, and then the valve 34 is closed. The purge time is governed by the capacity of the Freon-22 reclamation system, if purge gas reclamation is desired. For a suitably sized reclamation system the purge time is insignificant compared to the equilibration time of the vessel after purging (17 days). The purge stream is stopped and the system 20 equilibrates to ambient temperature, e.g., 70° F., and the corresponding Freon-22 vapor pressure. During this equilibration, additional portions of the conditioning charge 10, e.g., liquid Freon-22, is vaporized and condenses on the interior 26 of the tank 22 to produce reflux liquid. Approximately 40% of the total mass of the conditioning charge in the vessel is vapor when the system reaches equilibrium.

The foregoing heating/condensation/purging process is repeated any number of times or cycles for a given gas product. For this example, there is only one cycle used.

Upon completion of a suitable number of cycles for a given product, the tank 22 is drained of its used (degraded) liquid conditioning charge 10, and/or vented of conditioning vapor dependent upon the product and specification for which the conditioning process is performed. The vessel is now clean and ready for filling with a specified amount or charge of fresh ultra high purity liquified gas.

It should be pointed out at this juncture that the first three steps of the process as described above and as shown in FIGS. 1 and 2, i.e., the filling of the tank with the conditioning charge, the energizing of the heating element and the heating of the conditioning charge for a time sufficient to provide a thorough washing of the interior surface of the tank, constitute the basic steps of the process. The remaining steps, e.g., the purging of the vapor as shown in FIG. 3 and the reclamation, if any of the liquified gas from it or from the drained used conditioning charge, are optional, depending on the product for which the process is carried out. While the purging step is optional, it can never the less be quite valuable. In this regard, since the purging of hot vapor from the interior of the tank will inherently result in the lowering of the temperature of the tank's inner wall surface, thereby enabling any additional vapor produced by the heating element to condense on the that wall surface, extension of the reflux time will be achieved through usage of a purging step.

As will be appreciated by those skilled in the art preferred operating conditions are dependent upon the product for which the process is performed. In general, as discussed above, the foregoing process and the system for carrying it out are applicable to any gas that can be liquefied at or above ambient temperature. The temperature of the heating step should be maintained under the maximum design temperature of the heating element or vessel or it should be maintained below the temperature at which the vapor pressure of the liquid product exceeds the maximum design pressure of the vessel. With respect to the purge step, if utilized, it is preferable to execute it as quickly as possible so as to generate sufficient reflux to thoroughly wash the walls during this portion of the cycle.

The minimum number of cycles to condition a tank 22 or other vessel in accordance with this invention is one. The maximum number of cycles for which the process is performed is dependent upon the product and its specification for which the steps are carried out.

Referring now to FIGS. 4–7 the details of a system 100 and method for conditioning a tank 22 for storing a liquified gas which liquifies above, at or below ambient temperature to wash the internal walls of a tank will now be discussed. The following discussion will first focus on the use of that system to condition a tank with a liquified gas which liquifies below ambient temperature. Among those gases that can be used by the system 100 and the method of this aspect of the invention are Nitrogen, Oxygen, Argon, Freon-14, Carbon Dioxide, Carbon Monoxide, Silane, Nitrous Oxide, Nitrogen Trifluoride, and Fluorine. It should be noted that the foregoing gases are merely exemplary of many other gases that can be used which liquify below ambient temperature. Moreover, since this system 100 can also be used with gases that liquify above and at the ambient temperature, all of the gases that can be used with the system 20 can also be used with the system 100 as will be described later.

The system 100 and process carried out by the embodiment of FIGS. 4–7 is similar in many respects to that of the embodiment of FIG. 1. Thus, in the interest of brevity and drawing simplicity, the common components/items of those two embodiments will be given the same reference numerals and the details of their construction, arrangement and operation will not be reiterated. Moreover, even though the gas used in the system 100 may liquify below the ambient temperature, whereas the gas for the embodiment of FIGS. 1–3 liquifies at or above the ambient temperature, the gas, its vapor, condensation front and purge flow of the embodiment of FIGS. 4–7 will all be given the same reference numerals as that of the embodiment of FIGS. 1–3.

The system 100 is identical to the system 20, except that it doesn't include a heating element and an associated controller and the tank is insulated all around. When dealing with gases that liquify at or above the ambient temperature, in order to cause a conditioning charge of that liquid to vaporize it is necessary to apply a temperature difference to the tank. In the embodiment of FIGS. 1–3 this is accomplished by the application of heat to the tank. Where the gas liquifies below the ambient temperature, the application of the temperature difference to the tank to result in the vaporization and condensation of the conditioning charge of that liquid can be accomplished without the application of heat to the tank. Thus, as will be described in detail later, with the system 100 the application of a temperature difference to the tank 22 to produce the desired vaporization and condensation is accomplished by cooling the tank. This can be accomplished by venting of the liquified gas vapor from the tank.

The details of the operation of the system 100 and the method of use will now be described for an exemplary gas that liquifies below the ambient temperature, e.g., Freon-14. First, the bulk storage and delivery vessel or tank 22 is charged With a cooling charge 18 of the liquid product to lower the temperature of the tank's wall(s). This step is required for the first cycle of all gases that liquify below the ambient temperature, such as the Freon-14 of this example, but is optional for all gases that liquify above or at the ambient temperature, e.g., the gases discussed with reference to FIGS. 1–3.

Figure 4:
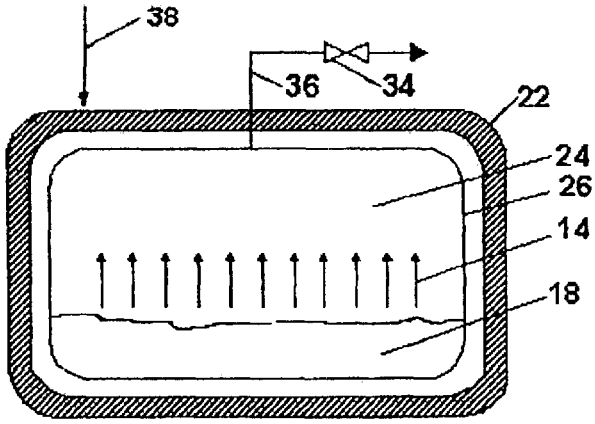
FIG. 4 is a schematic diagram of another embodiment of a system of the subject invention shown at an initial step in the conditioning of a bulk container, e.g., a storage tank for storing a charge of an ultra high purity liquified gas which is liquified below the ambient temperature.

In this example, it shall be assumed that the tank is initially at 70° F. A cooling charge of a liquid product 18 is introduced into the interior of the tank, with the vent valve open, whereupon all of the introduced cooling charge vaporizes as it exchanges heat with the walls of the vessel. Further cooling charge is introduced, until it begins to accumulate, as shown in FIG. 4, whereupon the temperature of the tank and the cooling charge are sufficient to hold a conditioning charge of liquid under its own vapor pressure, e.g., approximately −160° F. The valve is then closed. While the valve is open the purged gas exiting the tank can be sent to reclamation or discarded. When the purge valve is closed liquid charging ceases.

Figure 5:
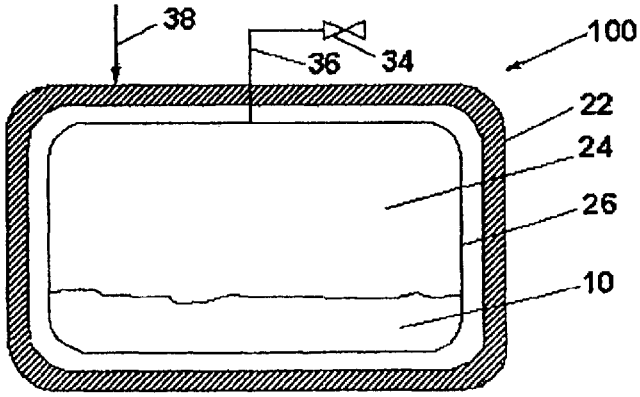
FIG. 5 is a schematic like that of FIG. 4, but showing a later step in the conditioning of the bulk container.

Next the purge valve 34 is closed and the tank is charged or partially filled, e.g., 10% of the volume of the tank, with the conditioning charge 10 of the ultra high purity product as shown in FIG. 5. That product is provided from a source (not shown) where the product is held at temperature, e.g., −130° F., whose vapor pressure is above the ambient. Next the tank is allowed to equilibrate for a period of time specific to the particular liquified gas 10, e.g., 4 hours for Freon-14, whereupon a portion of the conditioning charge 10 vaporizes to form vapor 12 and the pressure in the vessel rises as the system equilibrates.

Figure 6:
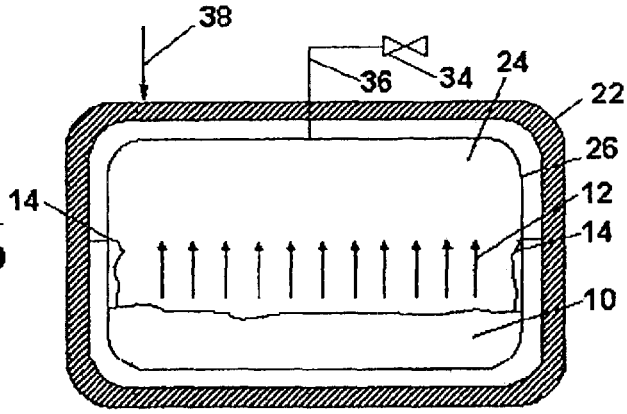
FIG. 6 is a schematic like that of FIGS. 4 and 5, but showing a still later step in the conditioning of the bulk container.

During this period of time the vapor condenses on the cooler interior surface 26 of the tank, to generate the liquid reflux condensation front 14 as shown in FIG. 6. As discussed above, this condensate or "reflux liquid" drips or otherwise flows back along the tank's interior surface 26 to the liquid body 10 of the conditioning charge under the influence of gravity, thereby carrying with it any contaminants that had been on that surface. At the end of this equilibration period the tank and the conditioning charge are at a temperature of approximately −126° F. Approximately 70% of the total mass of the Freon-14 in the tank is liquid when the contents reach equilibrium.

If this conditioning action is sufficient for the particular application, no further conditioning needs to be accomplished and the vapor 12 can be vented for disposal or reclamation, and the conditioning charge 10 can be drained for disposal or reclamation. The tank can then be filled with the storage charge of the product.

Figure 7:
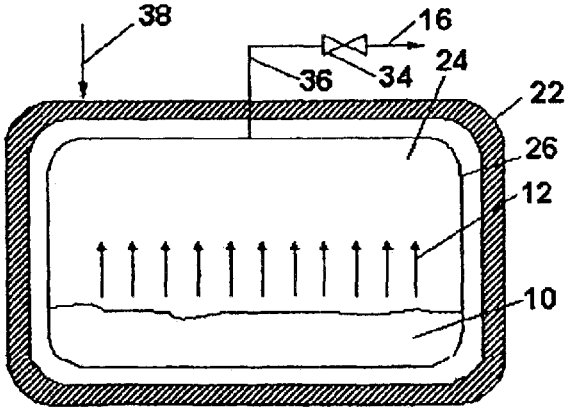
FIG. 7 is a schematic like that of FIGS. 4–6, but showing a still later step in the conditioning of the bulk container.

If however, further conditioning is required, the purge valve 34 is opened as shown in FIG. 7, whereupon a portion of the total mass of hot vapor 12 in the tank exits as purge stream 16 from the tank's interior 24 via line 36. The tank 22 equilibrates to a desired temperature for a period of time specific to the given gas product. For example, with Freon-14 the tank equilibrates to a temperature between −130° F. and −150° F. after a sufficient period of time has passed. The cooled tank is now ready to receive another conditioning charge 10, like shown in FIG. 5 and this process can be repeated any number of time (dependant upon the product) until the desired degree of conditioning has been achieved. As discussed above the purge vapor 16 can be reclaimed or disposed of and the conditioning charge drained for disposal or reclamation.

As will be appreciated by those skilled in the art the amount and duration of the purging of the vapor 12 takes into account the heat leaking through the walls of the tank 22 from the ambient surroundings, which leakage is shown schematically in FIGS. 4–7 by the arrow bearing the reference numeral 38.

The process as just described, i.e., the filling of the tank with the cooling charge to cool the tank, the filling of the tank with the conditioning charge, and the equilibration of the tank with the conditioning charge therein constitute the basic steps of the process of this embodiment and those basic steps constitute one cycle of the process. The additional steps of the purging of the vapor from the interior of the tank for a time specific for the particular gas used, and the subsequent equilibration after the purging is halted are optional and can be repeated any number of times depending on the gas product. The remaining steps, e.g., the reclamation of the purged gas and/or the reclamation or disposal of the drained used conditioning charge, are also optional, depending on the product for which the process is carried out.

The purge time as shown FIG. 7 is governed by the capacity of the Freon-14 reclamation system (assuming that the purge gas is desired to be reclaimed), but is insignificant compared to the equilibration time of the tank after purging.

Upon completion of a suitable number of cycles for a given product, the tank 22 is drained of its liquid conditioning charge 10 and the tank is now clean and ready for filling with a specified amount or charge of fresh ultra high purity liquified gas.

The system 100 can, as-mentioned above, be used with liquified gases, which are liquified at temperatures at or above the ambient temperature. In such a case the cooling of the interior walls by use of a cooling charge, such as shown in FIG. 4, is optional. If no cooling charge is used, the method entails charging the tank with the conditioning charge, as shown in FIG. 5. The conditioning charge is provided from a source (not shown) such that the storage temperature of the conditioning charge is above ambient temperature and at the vapor pressure corresponding to that temperature. The process is then carried out in the same manner as described above with reference to FIGS. 5–7.

If a cooling charge, like that shown in FIG. 4, is used as the initial step in the tank conditioning process of the embodiment of FIGS. 4–7, the process occurs in the same manner as described with reference to FIGS. 5–7, except that the initial cooling step shown in FIG. 4 may tend to increase the reflux time of the process. Moreover, the temperatures at the various times during the process carried out by the system of FIGS. 4–7 when used with gases liquified at or above the ambient temperature will be different than for gases that liquify below the ambient temperature.

Preferred operating conditions for the methods as just described are dependent upon the product for which the process is performed. The minimum number of cycles to condition a container is one. The maximum number of cycles for which the process is performed is dependent upon the product and its specification for which the steps are carried out.

As should be appreciated from the foregoing, the conditioning procedures and systems for carrying them out are particularly suitable for bulk containers that are transportable or stationary, that mayor may not contain integral external heating elements and that contain no external or internal condenser. The vapor and reflux liquid of ultra-high purity product, rather than an exogenous solvent serves to condition, e.g., wash, the walls of the by removing moisture, metals, and particle contamination therefrom. Since the conditioning is effected by the desired product, i.e., the ultra-high purity liquified gas, the cleaning step leaves no other potential contaminants behind and does not require rolling or other means of agitation of the container, thereby offering various advantages over the prior art.

Although illustrated and described herein with reference to specific embodiments, the present invention nevertheless is not intended to be limited to the details shown. Rather, various modifications may be made in the details within the scope and range of equivalents of the claims without departing from the spirit of the invention.

We claim:

1. A bulk container conditioning system, comprising:

(A) a bulk container for storing a charge of an ultra high purity liquified gas, the container having at least one wall with an interior surface bounding a hollow interior;

(B) a conditioning quantity of the ultra high purity liquified gas for disposition in said interior of said container so that a gas space is created above the level of said conditioning quantity of liquified gas;

(C) said system being arranged so that a temperature difference imposed on said container causes said conditioning quantity of liquified gas to produce vapor in said gas space that condenses on said interior surface of said container, without the use of a condenser, to produce a liquid reflux for washing the interior surface of said container to condition said container so that said container is ready to accept for storage therein the charge of ultra high purity liquified gas; and (E) a valve arranged to be opened for enabling at least a portion of said vapor to vent from said gas space.

2. The bulk container conditioning system of claim 1 additionally comprising:

(F) a heating member for heating said container to cause said conditioning quantity of liquified gas to produce said vapor in said gas space.

3. The bulk container conditioning system of claim 1 wherein said valve is openable to cause said vapor to condense on said interior surface of said container.

4. The bulk container conditioning system of claim 1 wherein said liquid reflux that washes the interior of the container reunites with said conditioning quantity of liquified gas within the container to produce a degraded quantity of the liquified gas, and wherein said container includes at least one port to enable said degraded quantity of the liquified gas to be removed from said container and a fresh charge of said ultra high purity liquified gas to be introduced therein.

5. The bulk container conditioning system of claim 1 wherein said container is insulated.

* * * * *